US009770393B2

(12) United States Patent
Zhou

(10) Patent No.: US 9,770,393 B2
(45) Date of Patent: Sep. 26, 2017

(54) MULTIFUNCTIONAL FEEDING-BOTTLE

(71) Applicant: SHENZHEN EASYCARE BABY PRODUCTS CO., LTD, Shenzhen (CN)

(72) Inventor: Qian Zhou, Dongguan (CN)

(73) Assignee: SHENZHEN EASYCARE BABY PRODUCTS CO., LTD, Shenzhen (CN)

( * ) Notice: Subject to any disclaimer, the term of this patent is extended or adjusted under 35 U.S.C. 154(b) by 214 days.

(21) Appl. No.: 14/745,596

(22) Filed: Jun. 22, 2015

(65) Prior Publication Data

US 2016/0067146 A1 Mar. 10, 2016

(30) Foreign Application Priority Data

Sep. 5, 2014 (CN) ..... 2014 1 0454094

(51) Int. Cl.
*A61J 9/04* (2006.01)
*A61J 9/00* (2006.01)
(Continued)

(52) U.S. Cl.
CPC ..... *A61J 9/001* (2013.01); *A61J 9/006* (2013.01); *A61J 9/04* (2013.01); *A61J 9/0623* (2015.05);
(Continued)

(58) Field of Classification Search
CPC A61J 9/001; A61J 9/0623; A61J 9/006; A61J 9/04; A61J 11/0085; A61J 9/003; A61J 9/08
See application file for complete search history.

(56) References Cited

U.S. PATENT DOCUMENTS 4,215,785 A * 8/1980 Schwaiger ..... A61J 9/008 215/11.6
4,557,392 A * 12/1985 Ryan ..... A61J 9/00 215/11.1
(Continued)

FOREIGN PATENT DOCUMENTS

CN 2737353 11/2005
CN 201492702 6/2010
(Continued)

OTHER PUBLICATIONS

Office Action dated Sep. 13, 2016 for priority application CN201410454094.X, 6 pages. Chinese only.

*Primary Examiner* — Tri Mai
(74) *Attorney, Agent, or Firm* — Hamre, Schumann, Mueller & Larson, P.C.

(57) ABSTRACT

The present patent application discloses a multifunctional feeding-bottle, including an outer cup, a liner, a nipple assembly connected to an opening of the outer cup, and a bottom cover connected to the bottom of the outer cup. The feeding-bottle further includes a valve piece disposed between the bottom of the outer cup and the bottom cover. An air inlet is disposed in a central part of a body of the valve piece. A stiffener is disposed at a part other than the air inlet. A cavity is formed between one side of the valve piece provided with the stiffener and the bottom cover. A sealing protrusion capable of sealing the air inlet is disposed at a central part of the bottom cover. An air vent is disposed at a part different from the sealing protrusion. The liner is disposed in the outer cup, and is configured to be removed from the outer cup.

17 Claims, 6 Drawing Sheets

(51) Int. Cl.
*A61J 9/06* (2006.01)
*A61J 11/00* (2006.01)
*A61J 9/08* (2006.01)

(52) U.S. Cl.
CPC ..... *A61J 11/0085* (2013.01); *A61J 9/003* (2013.01); *A61J 9/08* (2013.01)

(56) References Cited

U.S. PATENT DOCUMENTS 4,723,668 A * 2/1988 Cheng ..... A61J 9/04 215/11.5
5,499,729 A * 3/1996 Greenwood ..... A61J 9/04 137/845
5,791,503 A * 8/1998 Lyons ..... A61J 9/00 215/11.1
6,209,736 B1 * 4/2001 Chen ..... A61J 9/04 215/11.1
6,446,822 B1 9/2002 Meyers et al.
7,669,725 B2 * 3/2010 Randolph ..... A61J 9/001 215/11.1
8,727,147 B2 * 5/2014 Kemper ..... A61J 9/04 215/11.1
2008/0173612 A1 * 7/2008 Renz ..... A61J 9/04 215/260
2008/0237176 A1 * 10/2008 Pillado ..... A61J 9/04 215/11.5
2010/0044334 A1 * 2/2010 Barlow ..... A61J 11/02 215/11.5
2011/0180508 A1 * 7/2011 Fong ..... A61J 9/04 215/11.5
2013/0277327 A1 * 10/2013 Fong ..... A61J 9/04 215/11.5

FOREIGN PATENT DOCUMENTS

CN 202154879 U 3/2012
CN 202554500 11/2012
CN 202920654 5/2013
CN 203123062 8/2013
CN 204106602 1/2015

* cited by examiner

MULTIFUNCTIONAL FEEDING-BOTTLE

CROSS REFERENCE TO RELATED APPLICATIONS

This application claims priority of Chinese application No. 201410454094.X, filed on Sep. 5, 2014, the entire contents of which are all hereby incorporated by reference.

TECHNICAL FIELD

The present patent application relates to the field of infant feeding tools, and in particular, to a multifunctional feeding-bottle.

BACKGROUND

A bottom-ventilating feeding-bottle available in the market has a principle that an elastic base is disposed at the bottom of the feeding-bottle, and an opening is cut on the elastic base to achieve ventilation. However, the defect of the product is that milk will leak easily.

A glass feeding-bottle is unsafe and fragile, and a baby is easily hurt by the broken glass. A method for solving this problem in the market is: adding an enclosure outside a glass liner, and a soft rubber anti-vibration pad is provided between the enclosure and the liner, so as to make the feeding-bottle anti-shock and safe. Because of the own structure, the outer cup only has a protection function, and does not have a feeding function, so that the product is complicated in structure but simple in function.

There is also a two-in-one feeding-bottle available in the market, which is a combination of a safety glass feeding-bottle and a bottom-ventilating feeding-bottle. Although the problem of a function combination can be solved, a bottom-ventilating valve does not have an anti-shock function, so an anti-shock pad is further required, which is rather inconvenient to replace. Moreover, the structure of the ventilating valve has a potential risk of milk leakage, and is unpractical.

The disclosed content of the background is merely used to assist understanding of the conception and technical solutions of the present patent application, and does not necessarily belong to the prior art of the present patent application. When there is no clear evidence proving that the above content has been disclosed before the application date of the present patent application, the background should not be used to evaluate the novelty and inventive step of the present application.

SUMMARY

The present patent application is directed to provide a multifunctional feeding-bottle, so as to solve the technical problems of simple function and inconvenient use of the prior art.

Therefore, the present patent application provides a multifunctional feeding-bottle, including an outer cup, a liner, a nipple assembly connected to an opening of the outer cup, a bottom cover connected to the bottom of the outer cup, and a valve piece disposed between the bottom of the outer cup and the bottom cover. An air inlet is disposed at a central part of a body of the valve piece, and a stiffener is disposed at a part other than the air inlet. A cavity is formed between a side of the valve piece provided with the stiffener and the bottom cover. A sealing protrusion capable of sealing the air inlet is disposed at a central part of the bottom cover. An air vent is disposed at a portion different from the sealing protrusion. The liner is disposed in the outer cup, and is configured to be removed from the outer cup.

In one embodiment, the present patent application may further have the following technical features:

A vertical sealing ridge is disposed at the periphery of the valve piece, and two sides of the vertical sealing ridge are respectively closely attached to the liner and the outer cup.

A horizontal sealing ridge is disposed at the periphery of the valve piece, and two sides of the horizontal sealing ridge are respectively closely attached to the outer cup and the bottom cover.

A head of the protrusion is in a spherical shape, a hemispherical shape, a cone shape or a truncated cone shape capable of matching with the air inlet.

A central part of the body of the valve piece is a recess, a ventilating protruding portion is disposed at a central position of the recess, the air inlet is disposed at a top end of the ventilating protruding portion, and the top end of the ventilating protruding portion is not higher than the body of the valve piece.

The valve piece is made of medical silica gel.

More than two stiffeners are provided and uniformly distributed on the body of the valve piece.

A top of the stiffener is in a circular shape, and a height of the stiffener is 2-10 mm.

The liner is made of glass.

The multifunctional feeding-bottle further includes an automatic straw and a grasp handle connected to the outer cup.

Compared with the prior art, beneficial effects of the present patent application are as follows. By forming a cavity between a valve piece and a bottom cover, and disposing a sealing protrusion and an air vent at the bottom cover, the cavity may be in communication with the atmosphere. Therefore, a bottom-ventilating feeding-bottle may be formed when a liner is removed from an outer cup, so as to be used for a baby to drink milk, and a desirable anti-leakage function is provided. When the liner is placed into the outer cup, the outer cup and the valve piece may form an anti-shock protection function on the liner, so that it is not easily broken, and even it is broken, broken pieces generated by the liner may be wrapped in the outer cup, so as to effectively prevent a human body from being hurt by the broken pieces. The multifunctional feeding-bottle of the present patent application is dual-use, and can be used in different growth stages of a baby, which is convenient and cost-saving.

In an embodiment, a central part of the body of the valve piece is a recess. A ventilating protruding portion is disposed at a central position of the recess. The air inlet is disposed at a top end of the ventilating protruding portion, and the top end of the ventilating protruding portion is not higher than the body of the valve piece. This structure reserves enough moving space for the ventilating valve when the baby drinks milk, so as to ensure ventilation during milk drinking, and ensure sealing in a non-drinking state to prevent milk leakage.

BRIEF DESCRIPTION OF THE DRAWINGS

The disclosure will become more fully understood from the detailed description given herein below for illustration only, and thus are not limitative of the disclosure, and wherein.

DETAILED DESCRIPTION

Figure 1:
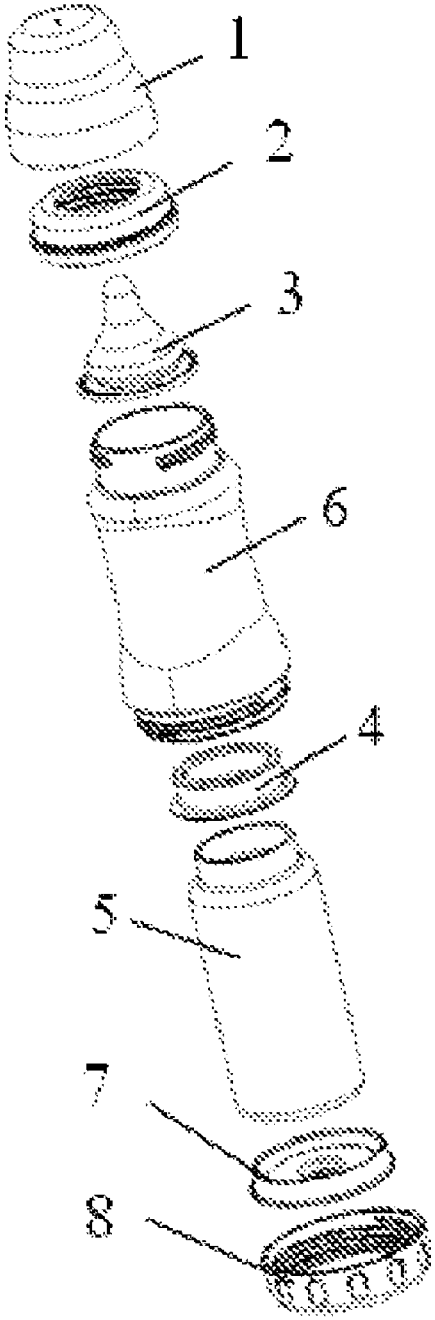
FIG. 1 is an exploded view of a multifunctional feeding-bottle according to an embodiment of the present patent application.

To facilitate correct understanding, the following is a definition of a technical term that will be involved in the text:

A "stiffener" refers to: a rib protruding from a body of a valve piece, which may be continuous circular shaped, and may also be discontinuous circular shaped (that is, having multiple sections of ribs disposed at an interval).

A multifunctional glass feeding-bottle of the present patent application includes an outer cup, a liner, a nipple assembly connected to an opening of the outer cup, and a bottom cover connected to the bottom of the outer cup. The multifunctional glass feeding-bottle further includes a valve piece disposed between the bottom of the outer cup and the bottom cover. An air inlet is disposed in a central part of a body of the valve piece. At least one circle of stiffener (or referred to as an annular stiffener) is disposed at a part other than the air inlet. A cavity is formed between one side of the valve piece provided with the stiffener and the bottom cover. A sealing protrusion capable of sealing the air inlet is disposed at a central part of the bottom cover, and an air vent is disposed at a part different from the sealing protrusion. The liner is disposed in the outer cup, and is configured to be removed from the outer cup.

The feeding-bottle, the same as a common glass feeding-bottle, may be used to feed a new born infant. When the infant grows to a certain stage and the feeding-bottle needs to be used as a bottom-ventilating feeding-bottle, the liner and sealing components used cooperatively are removed, so that it can be used as a bottom-ventilating feeding-bottle for the infant to drink milk.

The features and technical advantages of the present patent application have been briefly described in the foregoing, so as to better understand the detailed descriptions of the present patent application. Other features and advantages of the present patent application are described in the following. A person skilled in the art should understand that the disclosed concept and specific embodiments can be easily used as a basis for modifying or designing another structure to implement the same objective of the present patent application. A person skilled in the art should also know that the equivalent structure does not depart from the spirit and scope of the present patent application. Inventive features considered as characteristics of the present patent application, a structure and a method for implementing the same, and further objectives and advantages will be better understood through the following descriptions with reference to the accompanying drawings. However, it should be noted that, the features are provided merely for description and illustration, and are not indented to limit the definition of the present patent application.

The present patent application is further described in detail through embodiments with reference to FIG. 1 to FIG. 7. It should be emphasized that, the following descriptions are merely exemplary, and are not intended to limit the scope and application of the present patent application.

Embodiment 1

Figure 2:
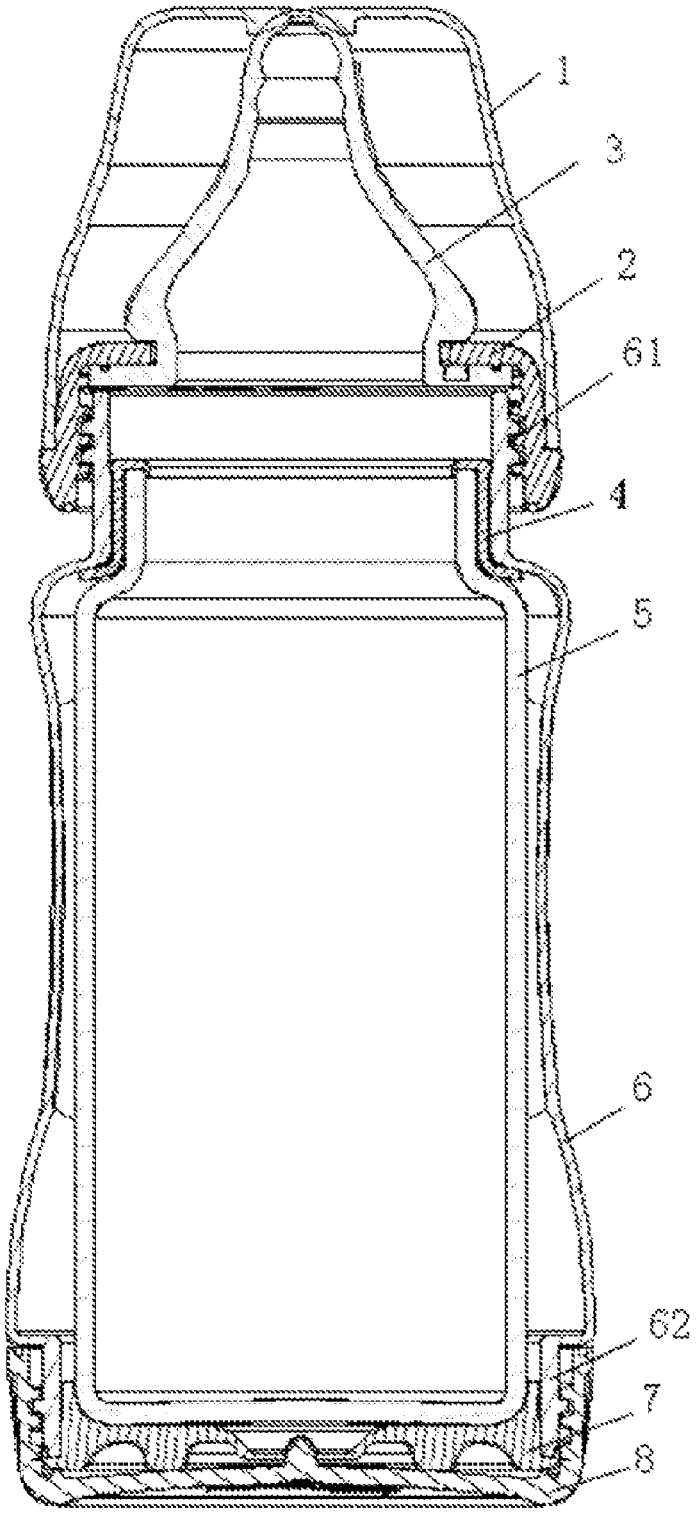
FIG. 2 is a sectional view of the multifunctional feeding-bottle according to the embodiment in FIG. 1 when being used as a glass feeding-bottle.
Figure 3:
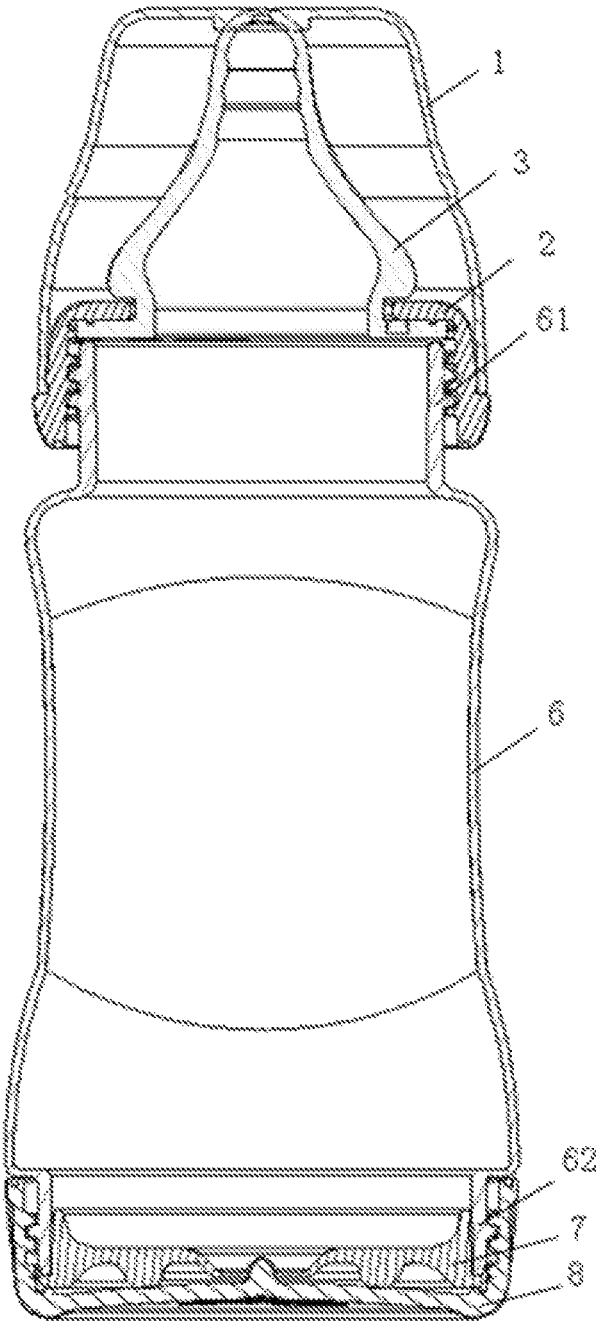
FIG. 3 is a sectional view of the multifunctional feeding-bottle according to the embodiment in FIG. 1 when being used as a bottom-ventilating feeding-bottle.

As shown in FIG. 1 to FIG. 3, a feeding-bottle of this embodiment includes an outer cup 6, a bottom cover 8, a valve piece 7, a glass liner 5, a bottle opening case 4, a screw cap 2, a bottle cover 1, and a nipple 3. The bottle opening case 4 is made of silica gel material, and sleeves the glass liner 5. The glass liner 5 is placed in the outer cup 6, and is in tight fit the outer cup through the silica gel bottle opening case 4, so as to prevent liquid from permeating into the outer cup 6. The bottle opening case 4 is disposed between the glass liner 5 and the outer cup 6, so that the two are in tight fit and are sealed. The nipple 3 is sleeved into the screw cap 2, and is connected to the opening 61 of the outer cup 6 by using the screw cap 2 in a threaded manner. The bottom cover 8 is threaded to the bottom 62 of the outer cup 6.

Figure 4:
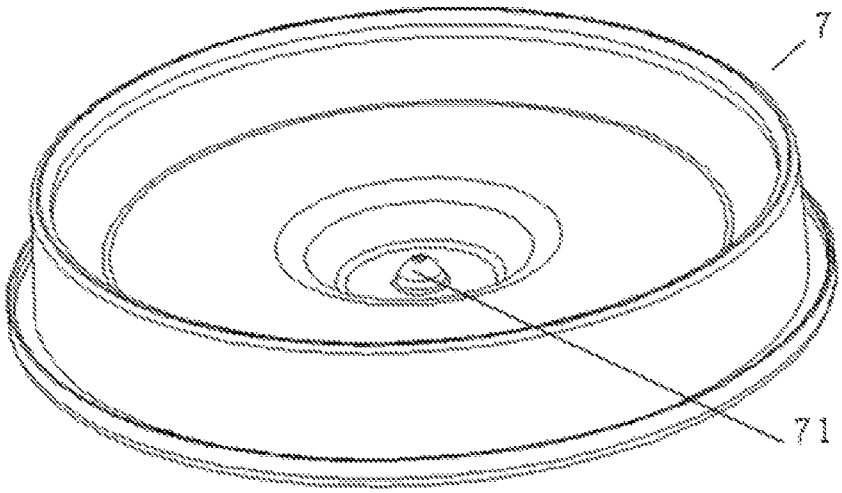
FIG. 4 is a schematic structural view of a valve piece in the multifunctional feeding-bottle according to the embodiment in FIG. 1.
Figure 5:
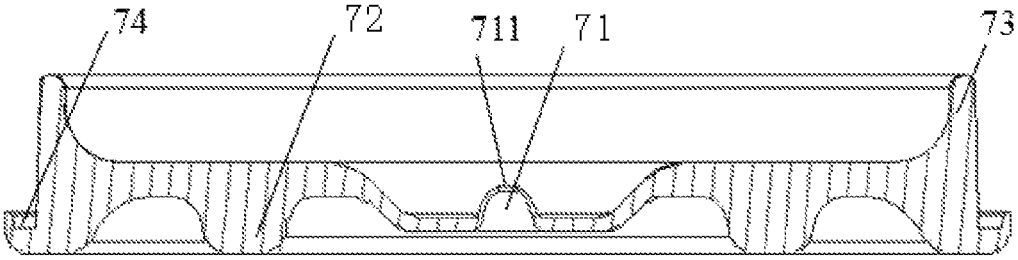
FIG. 5 is a sectional view of the valve piece in FIG. 4.

As shown in FIG. 4 and FIG. 5, the valve piece 7 includes a ventilating protruding portion 71, an air inlet 711, and a stiffener 72. The ventilating protruding portion 71 is disposed at the center of a recess at the central part of the valve piece 7. The air inlet 711 is opened at a top end of the ventilating protruding portion 71. The ventilating protruding portion 71 is not higher than an upper plane of the valve piece 7. The circular stiffener 72 may be designed as an annular rib (which may be a continuous annular rib, or an annulus formed by multiple discontinuous ribs or protrusions). At least one stiffener is provided, or more than two stiffeners are provided and uniformly distributed on a lower surface of the body of the valve piece 7 (a surface opposite to the bottom cover 8). The thickness of the stiffener may be 2 mm to 10 mm, and preferably 4 mm to 6 mm. An end portion of a free end of the stiffener abuts against the bottom of the bottom cover 8, so as to achieve an anti-shock function. A cavity is formed between the valve piece 7 and the bottom cover 8.

Moreover, a vertical sealing ridge 73 is further disposed at the periphery of the valve piece 7, and two sides of the vertical sealing ridge 73 are respectively closely attached to the liner 5 and the outer cup 6, so as to provide sealing and anti-shock functions. A horizontal sealing ridge 74 may be further disposed at the periphery of the valve piece 7, and two sides of the horizontal sealing ridge 74 are respectively closely attached to the outer cup 6 and the bottom cover 8, so as to seal a gap between the two. Because the horizontal sealing ridge 74 is pressed between the outer cup 6 and the bottom cover 8, even if the liner 5 is removed, the horizontal sealing ridge can also be fixedly clamped between the outer cup 6 and the bottom cover 8.

Figure 6:
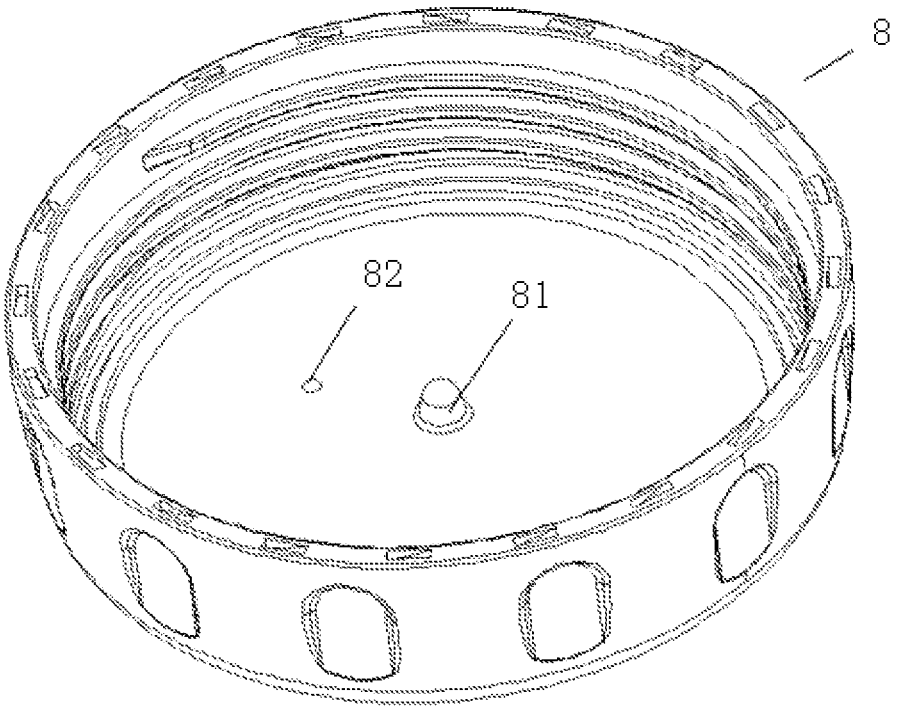
FIG. 6 is a schematic structural view of a bottom cover in the multifunctional feeding-bottle according to an embodiment in FIG. 1.

As shown in FIG. 6, a sealing protrusion 81 is disposed at a middle portion of the bottom cover 8, and a head thereof assumes a spherical shape, a hemispherical shape, a cone shape or a truncated cone shape capable of matching the air inlet 711, and abuts against the air inlet 711 of the valve piece 7. Moreover, the bottom cover 8 is further provided with an air vent 82, which enables the cavity between the valve piece 7 and the bottom cover 8 to be in communication with the atmosphere in a specific condition.

The valve piece 7 may be formed by using a nontoxic material. A basic condition for the material of the valve piece 7 is meeting FDA and EN14350 standards. The valve piece 7 is preferably formed by using medical silica gel, which has suitable elasticity, and can meet a requirement on switching between sealing and ventilating states of the feeding-bottle while meeting the sanitary requirement.

When being used as a bottom-ventilating feeding-bottle, the glass liner 5 and the silica gel bottle opening case 4 are removed, the silica gel valve piece 7 is still mounted between the bottom cover 8 and the outer cup 6, and the bottom of the outer cup 6 abuts against the silica gel valve piece 7, so as to provide sealing and anti-leakage functions. The sealing protrusion 81 of the bottom cover 8 abuts against the ventilating protruding portion 71 of the silica gel valve piece 7, and seals the air inlet 711. Therefore, the soft-hard coordination between the two enables desirable sealing, and can prevent milk leakage reliably. When a baby sucks the nipple to drink milk, if a common feeding-bottle is used, the pressure in the feeding-bottle is gradually reduced, so that the difficulty in drinking milk is gradually increased. However, when the feeding-bottle of the present patent application is used, the external air can enter the cavity between the valve piece 7 and the bottom cover 8 through the air vent 82 on the bottom cover 8. As a result, two sides of the valve piece 7 have a certain pressure difference (the pressure at the side of the bottom cover 8 is greater than the pressure inside the outer cup 6). When the pressure difference reaches a predetermined value, the silica gel valve piece 7 may be pushed to open, so that the air inlet 711 is separated from the sealing protrusion 81 on the bottom cover 8 to expose the air inlet 711. The feeding-bottle enters a ventilating state, and the air can enter the feeding-bottle to balance pressures inside and outside the feeding-bottle, so as to facilitate continuous milk drinking. At the same time when the inner and outer pressures are balanced, the air inlet 711 of the silica gel valve piece 7 fits the sealing protrusion 81 of the bottom cover 8 again to form a sealed state, so as to prevent milk leakage. As for the feeding-bottle of the present patent application, since the sealing protrusion 81 is located under and abuts against the air inlet 711 on the ventilating protruding portion 71 of the body of the valve piece 7, a support function may be provided. In addition to the support function of the stiffener 72, a function of sealing water may be provided when there is a liquid pressure in the feeding-bottle, so as to ensure water-tightness. The ventilating state of the present patent application needs cooperation of the air inlet 711 of the valve piece 7 and the sealing protrusion 81, and the two separated structure may better implement actions of combination and separation. Therefore, the present patent application achieves easier and more reliable ventilation.

When the liner is placed into the outer cup and is used as a glass feeding-bottle, the outer cup and the valve piece can provide an anti-shock protection function for the liner, so that it is not easily broken, and even it is broken, the broken pieces generated by the liner can be completely wrapped in the outer cup, thereby effectively preventing a human body from being hurt by the broken pieces.

Embodiment 2

Figure 7:
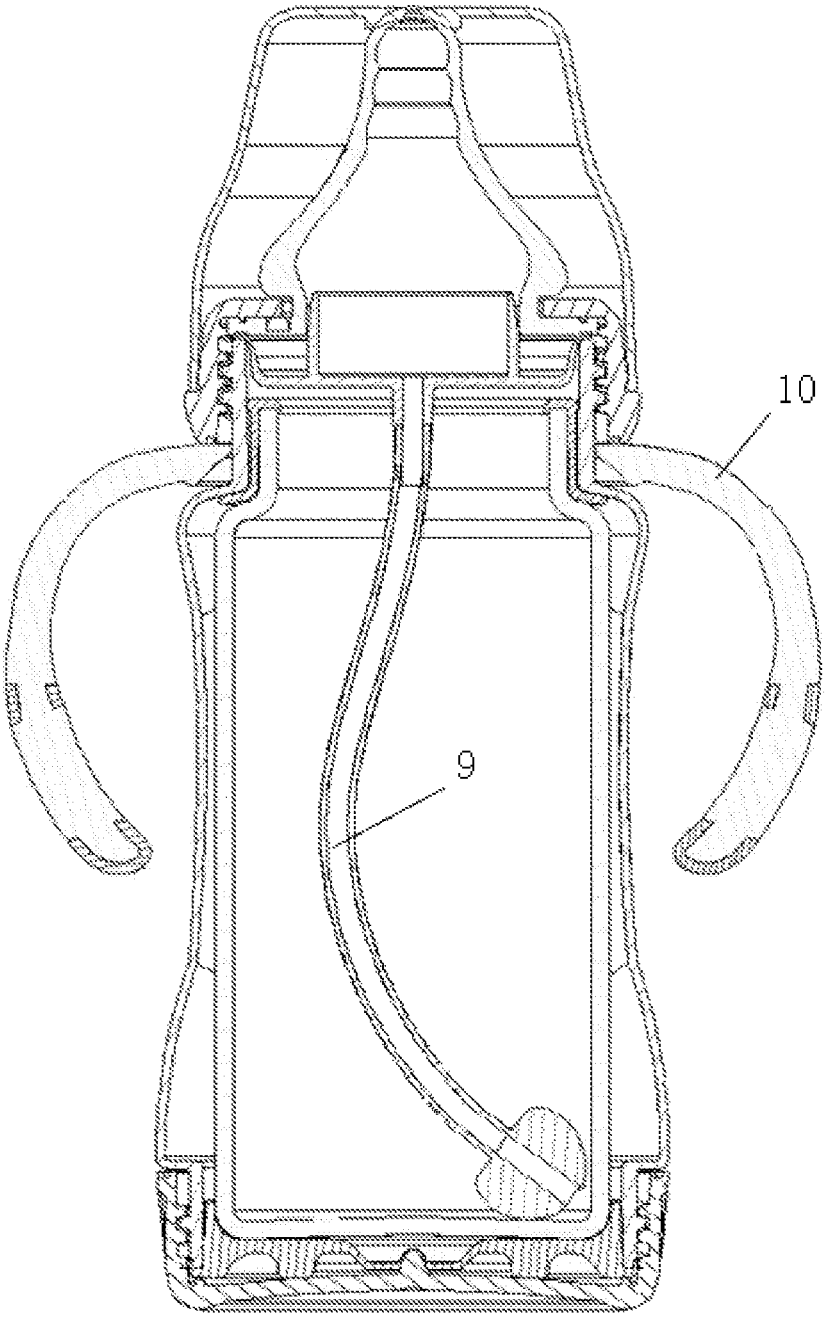
FIG. 7 is a schematic sectional view of another specific implementation manner having a handle and a straw.

This embodiment is an improvement of Embodiment 1, and as shown in FIG. 7, this embodiment further includes an automatic straw 9 and a grasp handle 10 connected to the outer cup. The disposition of the automatic straw 9 ensures drinking of milk at any angle within 360°, and the grasp handle 10 can exercise a grasping capability of the baby, and is comfortable and convenient in use.

A person skilled in the art should know that various variations on the above descriptions are available, and therefore, the embodiments are merely used to describe one or more embodiments.

Although exemplary embodiments of the present patent application have been described and illustrated, a person skilled in the art should know that various variations and replacements may be made thereto without departing from the spirit of the present patent application. In addition, many modifications may be made to adapt specific situations to the teaching of the present patent application without departing from the central concept of the present patent application described herein. Therefore, the present patent application is not limited by the specific embodiments disclosed herein, and the present patent application may further include all embodiments and equivalents thereof within the scope of the present patent application.

The invention claimed is:

1. A multifunctional feeding-bottle, comprising:

an outer cup, a liner, a nipple assembly connected to an opening of the outer cup, a bottom cover connected to a bottom of the outer cup, and a valve piece disposed between the bottom of the outer cup and the bottom cover, wherein an air inlet is disposed in a central part of a body of the valve piece, a stiffener is disposed at a part other than the air inlet; a cavity is formed between one side of the valve piece provided with the stiffener and the bottom cover, a sealing protrusion capable of sealing the air inlet is disposed at a central part of the bottom cover, and an air vent is disposed at a part different from the sealing protrusion; and the liner is disposed in the outer cup, and is configured to be removed from the outer cup; and wherein the central part of the body of the valve piece is a recess, a ventilating protruding portion of the valve piece is disposed at a central position of the recess, the air inlet is disposed at a top end of the ventilating protruding portion, and the top end of the ventilating protruding portion is not higher than an upper edge of the valve piece.

2. The multifunctional feeding-bottle according to claim 1, wherein a vertical sealing ridge is disposed at a periphery of the valve piece, and two sides of the vertical sealing ridge are respectively closely attached to the liner and the outer cup.

3. The multifunctional feeding-bottle according to claim 1, wherein a horizontal sealing ridge is disposed at a periphery of the valve piece, and two sides of the horizontal sealing ridge are respectively closely attached to the outer cup and the bottom cover.

4. The multifunctional feeding-bottle according to claim 1, wherein a head of the sealing protrusion is in a hemispherical shape capable of matching with the air inlet.

5. The multifunctional feeding-bottle according to claim 1, wherein the valve piece is made of medical silica gel.

6. The multifunctional feeding-bottle according to claim 1, wherein more than two stiffeners are provided and uniformly distributed on the body of the valve piece.

7. The multifunctional feeding-bottle according to claim 1, wherein a top of the stiffener is in a circular shape, and a height of the stiffener is 2-10 mm.

8. The multifunctional feeding-bottle according to claim 1, wherein the liner is made of glass.

9. The multifunctional feeding-bottle according to claim 1, wherein the multifunctional feeding-bottle further comprises an automatic straw and a grasp handle connected to the outer cup.

10. The multifunctional feeding-bottle according to claim 2, wherein the multifunctional feeding-bottle further comprises an automatic straw and a grasp handle connected to the outer cup.

11. The multifunctional feeding-bottle according to claim 3, wherein the multifunctional feeding-bottle further comprises an automatic straw and a grasp handle connected to the outer cup.

12. The multifunctional feeding-bottle according to claim 4, wherein the multifunctional feeding-bottle further comprises an automatic straw and a grasp handle connected to the outer cup.

13. The multifunctional feeding-bottle according to claim 1, wherein the multifunctional feeding-bottle further comprises an automatic straw and a grasp handle connected to the outer cup.

14. The multifunctional feeding-bottle according to claim 5, wherein the multifunctional feeding-bottle further comprises an automatic straw and a grasp handle connected to the outer cup.

15. The multifunctional feeding-bottle according to claim 6, wherein the multifunctional feeding-bottle further comprises an automatic straw and a grasp handle connected to the outer cup.

16. The multifunctional feeding-bottle according to claim 7, wherein the multifunctional feeding-bottle further comprises an automatic straw and a grasp handle connected to the outer cup.

17. The multifunctional feeding-bottle according to claim 8, wherein the multifunctional feeding-bottle further comprises an automatic straw and a grasp handle connected to the outer cup.

* * * * *